US007291053B2

(12) United States Patent
Mukaida

(10) Patent No.: US 7,291,053 B2
(45) Date of Patent: Nov. 6, 2007

(54) RADIO-CONTROLLED TOY TWO-WHEELED VEHICLE

(75) Inventor: Kenji Mukaida, Tokyo (JP)

(73) Assignee: Nikko Co., Ltd., Tokyo (JP)

( * ) Notice: Subject to any disclaimer, the term of this patent is extended or adjusted under 35 U.S.C. 154(b) by 53 days.

(21) Appl. No.: 10/557,443

(22) PCT Filed: May 23, 2003

(86) PCT No.: PCT/JP03/06485

§ 371 (c)(1),
(2), (4) Date: Nov. 18, 2005

(87) PCT Pub. No.: WO2004/103506

PCT Pub. Date: Dec. 2, 2004

(65) Prior Publication Data

US 2006/0276101 A1 Dec. 7, 2006

(51) Int. Cl.
*A63H 17/25* (2006.01)
*A63H 17/00* (2006.01)

(52) U.S. Cl. ..... 446/275; 446/279; 446/456

(58) Field of Classification Search ..... 446/233, 446/275, 288, 437, 440, 454, 456, 457, 279
See application file for complete search history.

(56) References Cited

U.S. PATENT DOCUMENTS 3,546,814 A 12/1970 Melendez
5,368,516 A * 11/1994 Hoeting et al. ..... 446/288
5,709,583 A * 1/1998 Suto et al. ..... 446/440
5,820,439 A * 10/1998 Hair, III ..... 446/233
6,074,271 A * 6/2000 Derrah ..... 446/457
6,729,933 B2 * 5/2004 Hoeting et al. ..... 446/275
6,786,796 B2 * 9/2004 Suto ..... 446/440
6,854,547 B2 * 2/2005 Moll et al. ..... 180/167

FOREIGN PATENT DOCUMENTS

JP 60-36316 10/1985
JP 6-49346 12/1994
WO WO95/11069 4/1995

OTHER PUBLICATIONS

Microfilm of the specificaiton and drawings annexed to the request of Japanese Utility Model Application No. 164595/1987 (Laid-open No. 69595/1989), (Yoshio Mizukado), May 9, 1989, Full text; all drawings (Family: none).

* cited by examiner

*Primary Examiner*—Kien T Nguyen
(74) *Attorney, Agent, or Firm*—Young & Thompson

(57) ABSTRACT

A radio-controlled toy two-wheeled vehicle where a front wheel support body is installed on a vehicle body without steering angle limitation and a doll portion is installed swingably on the upper part of the vehicle. The doll portion is moved by radio control vertically to an advance direction of the vehicle and parallel in a horizontal direction with respect to the vehicle body, so that steering is made by tilting the front wheel support body through the movement of doll's gravity center caused by the parallel movement of the doll. A doll movement control portion and travel control of the two-wheeled vehicle are conducted by radio. The doll movement control portion is mounted on the middle of the two-wheeled vehicle. A drive portion for driving the doll is fitted loosely in a hole portion cut in a doll's torso portion.

20 Claims, 3 Drawing Sheets

RADIO-CONTROLLED TOY TWO-WHEELED VEHICLE

TECHNICAL FIELD

The present invention relates to a two-wheeled toy vehicle by radio control, enabling its steering control with center of gravity control of a rider-like doll.

BACKGROUND ART

Conventionally, a two-wheeled vehicle running toy has been offered various devices due to less self-help and instability as compared with a four-wheeled vehicle running toy. The contents to be devised particularly include a steering method. Employed is the steering method by which an operator steers a real-vehicle by turning a handlebar and moving his or her center of gravity. On the other hand, as for a steering method in a toy, a case of directly steering a handle portion and a steering method through a rider-like doll have been proposed. Here, comparing with the real-vehicle, steering through the rider-like doll may reproduce a running state with more reality.

Then, when considering the inventions which have already been proposed as methods of steering rider-like dolls, Patent Document 1 discloses an aspect that a rider-like doll is mounted on a two-wheeled vehicle, and steering is performed by opening leg portions of the rider-like doll connected to an outrigger (Patent Document 1: U.S. Pat. No. 4,290,228).

In addition, Patent Document 2 discloses the contents that a rider rides a two-wheeled toy vehicle by radio control, and makes a weight shift with a swing support located beneath the rider for steering (Patent Document 2: U.S. Pat. No. 5,368,516, the national publication of translated version No. 9-504716).

Moreover, an aspect is disclosed that a balance weight is placed within a rider-like doll in a motorcycle toy to move its center of gravity by means of the balance weight (Patent Document 3: Japanese Utility Model Publication No. 6-49346).

In these proposals, servo horns are rigidly connected to a rider doll portion, so that the rider doll portion moves in synchronization with the servo horns in a state where positional relation therebetween is fixed. For this reason, the center of gravity movement takes place only when synchronized with the servo, with no flexibility of the movement of the rider doll. Thus, a turning radius is determined by the movement of the servo horns, and the turning radius is likely to enlarge.

In addition, a torsion spring is often used as a spring to restore a position of a rider doll so as to face the front. When the single torsion spring is used for restoration, it is necessary to increase a diameter of a spring shaft of the single torsion spring. However, increased spring shaft intensifies its strength, thus making it difficult to adjust the spring, and also requiring the strength of peripheral parts.

Meanwhile, it is difficult to make a two-wheeled toy vehicle by radio control set up on a standalone basis, and stabilizers are sometimes provided in a motorcycle as a device therefor. However, a stabilizer in a two-wheeled toy vehicle by radio control acts on operability depending on its position, or the presence or absence of the stabilizer to a large degree. That is, if those who use vehicle toys are beginners, the presence of a stabilizer is important in order to operate a two-wheeled toy vehicle by radio control without causing it to turn over. However, a senior of radio controlled two-wheeled vehicle toy running could operate the same without the presence of the stabilizer, and on the contrary, the presence thereof may impair the fun of the radio controlled two-wheeled vehicle toy running.

Whereat, a first object of the present invention to improve these problems is to synchronize center of gravity movement of a rider like doll with movement of a servo, as well as to use the center of gravity movement of the rider like doll to make a turning radius of the two-wheeled toy vehicle by radio control smaller, while maintaining flexibility of the rider like doll itself against the servo.

In addition, a second object is to thin a wire diameter of a torsion spring, as well as to use the torsion spring to ease restoration toward a front direction of the rider like doll.

Furthermore, a third object is to provide a stabilizer portion which is adjustable to change positions of attachment of the stabilizer or to attach the stabilizer, and which may be changed by a user of the two-wheeled toy vehicle by radio control depending on his or her operational skill levels.

DISCLOSURE OF THE INVENTION

To solve said problems, in the invention of a two-wheeled toy vehicle by radio control according to the present invention, wherein a front wheel support is mounted on to the vehicle body in a way that a steering angle is adjustable, a rider-like doll portion is swingably attached onto an upper portion of the vehicle body, this rider-like doll portion is moved perpendicular to a traveling direction and parallel to a horizontal direction with respect to the vehicle body by radio-control, and the front wheel support is tilted for steering by center of gravity movement resulting from the parallel movement of said rider-like doll, whose movement control portion and running control of the two-wheeled vehicle are under the radio-control.

The movement control portion of the rider-like doll is mounted in the center of the two-wheeled vehicle, and a drive portion which serves to drive the rider-like doll is loosely fitted into a hole portion carved in a body portion of the rider-like doll.

To this end, while driving force of the drive portion is transmitted to the rider-like doll, flexibility of the rider-like doll portion is increased because part of the drive portion is loosely fitted, enabling the center of gravity movement of the rider-like doll due to some factor other than the driving force.

The body portion of the rider-like doll may comprise a head portion which is connected by insertion of a lower protrusion into said body portion and a concave portion, upper arm portions which are connected to said body portion by ball joints, lower arm portions which are connected to said upper arm portions by ball joints, upper extremity portions which are connected to said body portion by ball joints, and lower extremity portions which are connected to said upper extremity portions by ball joints.

Each portion is connected by ball joints, so that the rider-like doll has considerable flexibility, movement of a real rider may be more easily reproduced in the movement of the rider-like doll, as well as the center of gravity movement of the rider-like doll is facilitated.

Note that these connecting portions may comprise not only ball joints, but also some connecting portions may comprise uniaxial joints or other joints.

In the lower arm portions, a handle portion disposed on the uppermost portion of a front wheel portion of the two-wheeled toy vehicle by radio control in a horizontal direction may be loosely fitted into hole portions provided in hand portions provided at end portions thereof.

The lower arm portions have high flexibility on rotation and the like of the connecting portions between the lower arm portions and the upper arm portions due to being fixed only to this handle.

In the lower extremity portions, pedal portions which are provided with a protrusion in the central lower portion of the two-wheeled toy vehicle by radio control in a horizontal direction may be loosely fitted into U shaped portions which are provided with a protrusion to shoe sole portions of the lower extremity portions.

Similarly, the lower extremity portions have flexible connections between the lower extremity portions and the upper extremity portions due to being fixed by the pedal portions, increasing flexibility of the movement of the rider-like doll.

The head portion may be heavier than the body portion in weight. The center of gravity of the rider-like doll may be easily moved by tilt without having to enlarge the tilt of the rider-like doll portion by setting the center of gravity to be a little higher.

The hole portion carved in the body portion may have a longer diameter of the body in a vertical direction than the diameter of the body in a horizontal direction.

A diameter size of the hole portion in a vertical direction gives rise to flexibility in the vertical direction, thus providing the movement of the rider-like doll with the flexibility.

The drive portion may comprise a servo portion having a motor built-in, shaft portions located in the center of said motor, a servo horn fitted into end portions of said shaft portions, retainer plate portions which are provided with a protrusion from said servo horn to the central portion in a rotation direction thereof, a pair of torsion spring portions which is connected in series and energized in a way that said servo horn is sandwiched from both side portions thereof, torsion spring fixed portions in which two shaft portions protrude in torsion spring directions, are respectively inserted into a cyclic portion of each torsion spring, and are disposed within the two-wheeled vehicle to fix the cyclic portion of the each torsion spring.

Use of two torsion springs allows reduced load per torsion spring, thus requiring less necessary strength. This provides reduced wire diameters of the torsion springs. Thus, the torsion springs of the present invention may be utilized in appropriate force.

A first stabilizer may be rotatably mounted at a distal end of the pedal portion. Use of the first stabilizer allows reduced turning radius.

There may be provided a connecting portion which is ratatably mounted so as to connect the pedal portions on both sides outside the first stabilizer, and a second stabilizer which is provided with a protrusion from a region of this connecting portion mounted with the pedals in a direction perpendicular to the connecting portion, and is attachably and detachably inserted outside an end portion of the protrusion portion.

Having the second stabilizer allows the vehicle body to be easily stabilized as an aid in getting out of balance.

The movement control portion of the rider-like doll and the running control of the two-wheeled vehicle may be under radio-control, or the movement control portion of the rider-like doll and the running control of the two-wheeled vehicle may be under wire-control.

BEST MODE FOR CARRYING OUT THE INVENTION

Other details, advantages, and features of the present invention will become apparent upon reading the following embodiments when taken in conjunction with the accompanying drawings.

Figure 1:
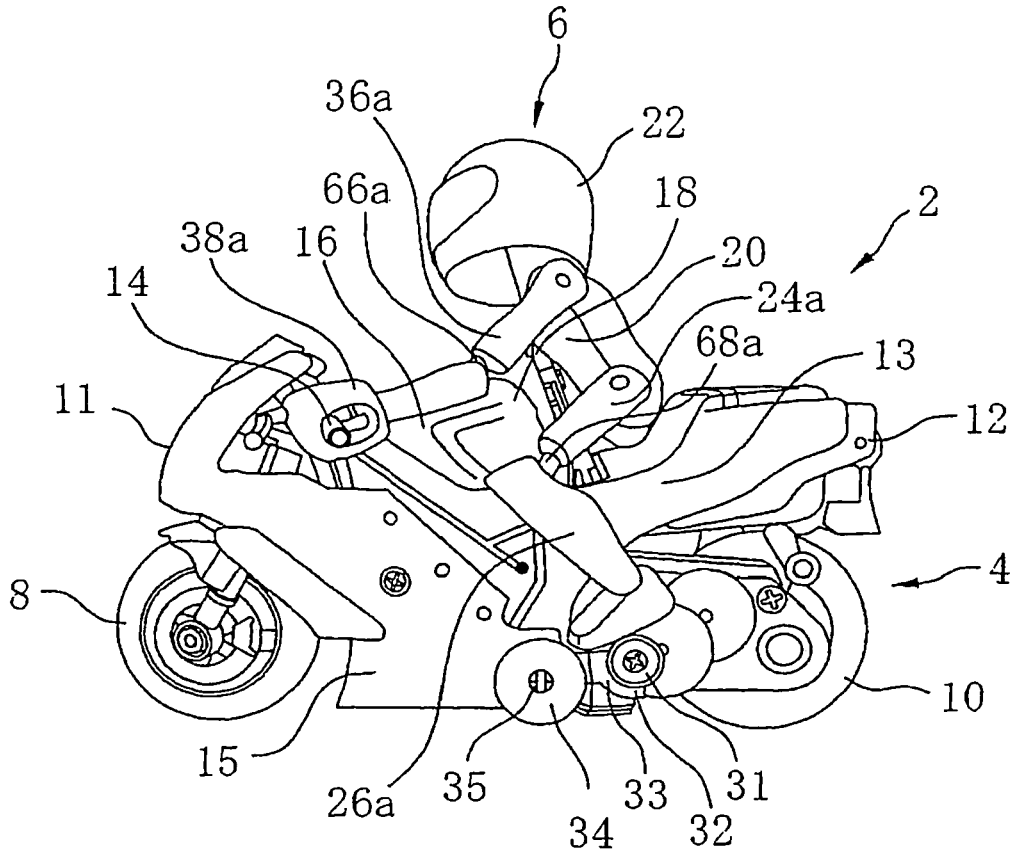
FIG. 1 is a side view showing illustrating an embodiment of a two-wheeled toy vehicle by radio control according to the present invention.

FIG. 1 is an oblique protrusion drawing showing a two-wheeled toy vehicle by radio control 2 to which the present invention is applied, of which 4 is a two-wheeled vehicle body by radio control, 6 a rider-like doll body, 8 a front wheel, 10 a rear wheel, 11 a front cowl, 12 a rear cowl, 13 a seat, 14 a handlebar, 15 a chassis cover, 16 a tank, and 18 a servo horn.

In a rider-like doll 6, a body portion 20 is disposed on the seat 13, a lower protrusion of a head portion 22 is disposed and inserted into a concave portion provided on an upper surface of the body portion 20, ball joints 62*a* and *b* of respective upper arm portions 36*a* and *b* are inserted into concave portions provided on both upper side portions of the body portion 20, and ball joints 64*a* and *b* of respective thigh portions 24*a* and *b* are inserted into concave portions provided on both lower side portions of the body portion 20, whereby the respective upper arm portions 36*a* and *b* and the respective upper extremity portions 24*a* and *b* are pivotally attached. Note that the head portion 22 may be pivotally attached to the body portion 20, but that it is preferable that the head portion 22 be allowed slight movement or be fastened thereto in terms of enhanced stability and design.

Figure 5:
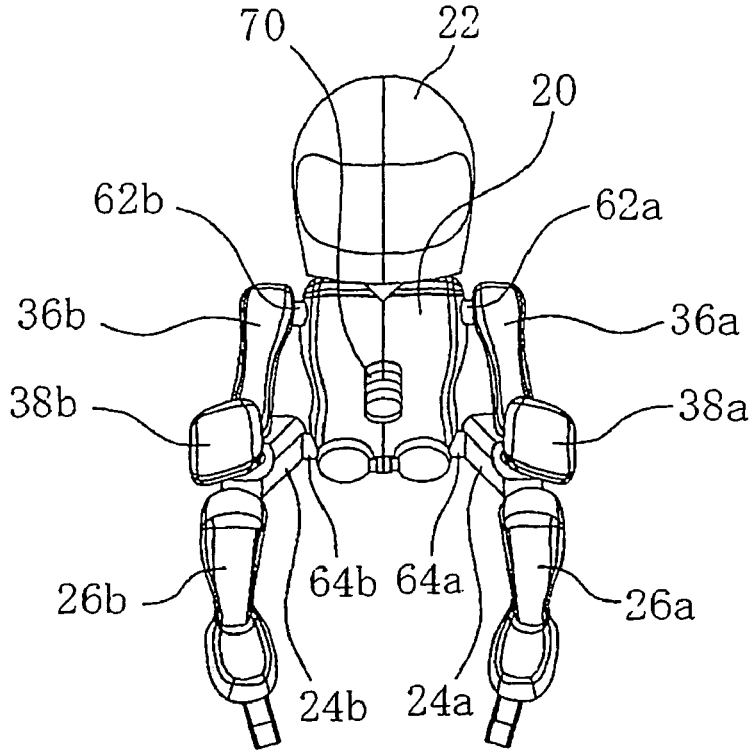
FIG. 5 is a front view illustrating the rider-like doll in an embodiment of the two-wheeled toy vehicle by radio control according to the present invention.

The body portion 20 has a hole portion 70 drilled therethrough in a vertically long ellipse with a diameter of the body in a vertical direction longer than the diameter of the body in a horizontal direction, as shown in FIG. 5. This hole portion 70 is pierced by a pin 46 provided at an end portion of a servo horn 18 connected to a servo system 40 shown in FIG. 2. When the servo system 40 rotates, the servo horn 18 moves rotationally to cause the pin 46 to move with a focus on servo shafts 44 within the hole portion 70. Hence, the body portion 20 moves on the seat 13.

The head portion 22 has sufficient weight for a weight shift, which is set enough to return from the weight shift at the time of rotation. Preferably, the head portion 22 is set so as to weigh more than the body portion 20 does.

In the upper arm portions 36*a* and *b*, ball joints 66*a* and *b* are provided with a protrusion at end portions thereof, inserted into concave portions provided in the respective lower arm portions 38*a* and *b*, and pivotally attached. Hand portions are contiguously provided at distal ends of the respective lower arm portions 38*a* and *b*, and hole portions are provided so that a handlebar 14 is passed therethrough.

In the upper extremity portions 24*a* and *b*, the ball joints 68*a* and *b* are further provided with a protrusion at bottom end portions thereof, inserted into concave portions provided in the lower extremity portions 26*a* and *b*, and pivotally attached. Shoe sole portions are contiguously provided at distal ends of the lower extremity portions 26*a* and *b*. Pedal portions 30 which are provided with a protrusion in the central lower portion of the two-wheeled running toy vehicle in a horizontal direction are loosely fitted into U shaped portions which are provided with a protrusion to the shoe sole portions.

A receiver, the servo system 40, and a drive portion necessary for radio control are disposed within a chassis cover 12 and a tank portion 16, and not shown.

Figure 2:
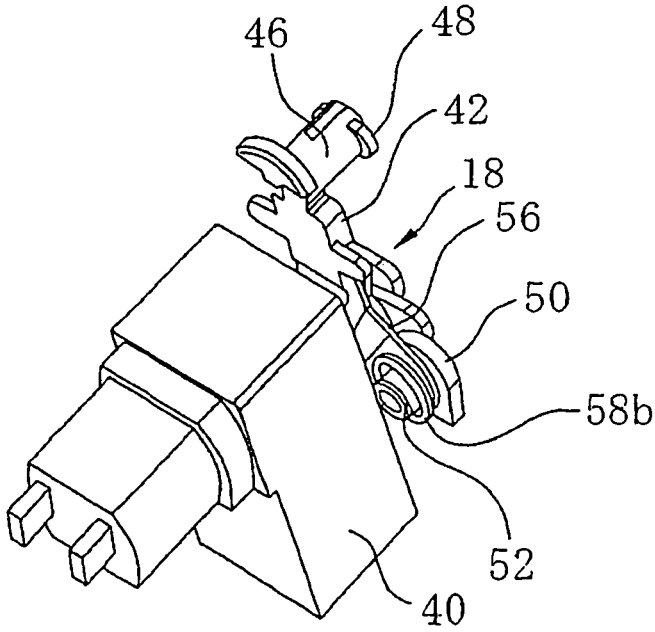
FIG. 2 is an oblique protrusion drawing illustrating a servo system in an embodiment of the two-wheeled toy vehicle by radio control according to the present invention.
Figure 3:
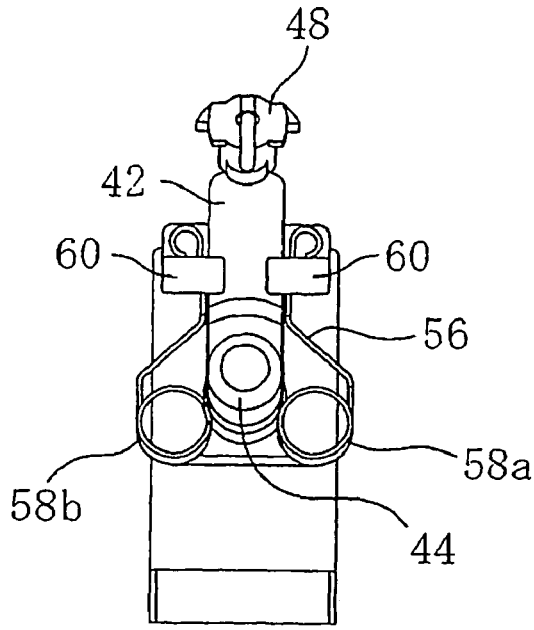
FIG. 3 is a front view illustrating the servo system in an embodiment of the two-wheeled toy vehicle by radio control according to the present invention.
Figure 4:
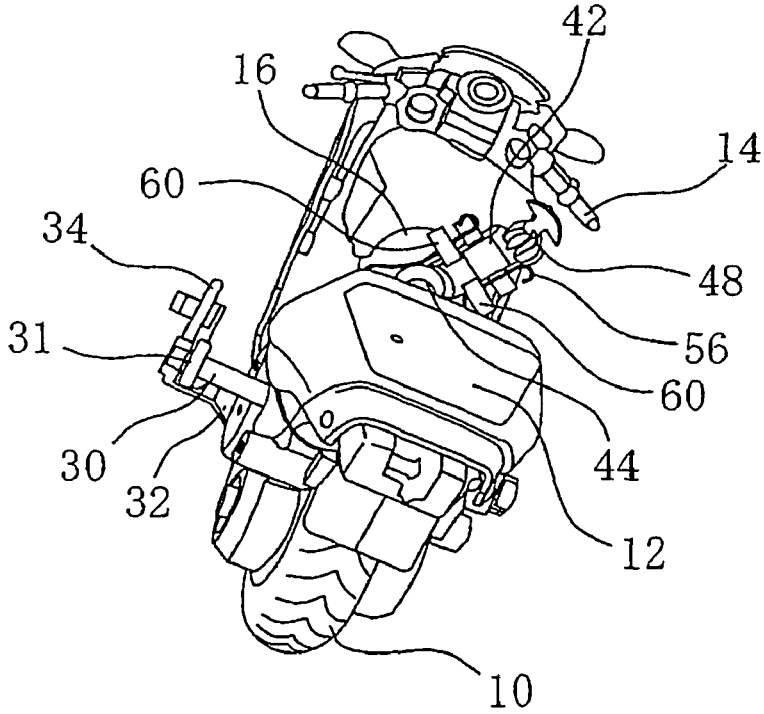
FIG. 4 is a rear view illustrating when a rider-like doll is eliminated in an embodiment of the two-wheeled toy vehicle by radio control according to the present invention.

Subsequently, the servo system 40 which drives the body portion 20 through the hole portion 70 will be described using FIG. 2 and FIG. 3. The servo system 40 is held between chassis portions within a chassis cover 15 and secured by a servo cover from above. The servo system 40 is disposed in a way that an upper surface having shaft portions 44 thereof faces a rear portion of the radio controlled two-wheeled vehicle toy 2, and end portions of the shaft portions 44 face slightly upward. A back surface of the servo system 40 is provided with a connection terminal to a control portion, and the shaft portions 44 are disposed front and center.

In the shaft portions 44, an elongated shaped servo horn 42 perpendicular to the shafts and parallel to an upper surface of the servo is disposed. At an end portion of the servo horn 42, the pin 46 protruding vertically from the servo horn 42 is provided. At a distal end of the pin 46, a locking portion 48 is provided with a protrusion in a direction perpendicular to the pin 46. This locking portion 46 is capable of preventing the pin 46 from dropping out of the hole portion 70 because the pin 46 is locked inside the hole when the pin 48 is inserted into the hole portion 70 provided in the body portion 20 of the rider-like doll 6.

Furthermore, the servo horn 42 is provided with torsion springs 56 which have two contiguous coil portions and which are disposed in a way that both end portions thereof insert the servo horn 42 from the right and left. Retainer plates 60 for retaining the torsion springs 56 between the shaft portions 44 and the pin 46 in the servo horn 42 are respectively protruded to both sides in a direction perpendicular to a long axis of the servo horn 42 and parallel to the upper surface of the servo.

The coil portions 58*a* and *b* of the torsion springs 56 are disposed axisymmetrically with respect to the shaft portions 44. Locking plates 50 are protruded so that the protrusion portions of the locking plates 50 are inserted into the coil portions 58*a* and *b* respectively. The locking plates 50 are screwed down to the chassis portions, so that the shaft portions 44 are locked even if they rotate.

In addition, since both ends of the torsion springs 56 are applied so that the servo horn 42 is located in the center, they are disposed on side portions of the servo horn 42 after being folded diagonally from both the coil portions 58*a* and *b*, respectively.

Subsequently, operation of the two-wheeled toy vehicle by radio control 2 according to the present invention will be described based on the aforementioned construction.

First, the two-wheeled toy vehicle by radio control 2 according to the present invention sends a control signal from a radio control transmitter, and is constructed so that a receiver receiving the signal and a control portion thereof control the aforementioned servo system 40.

Here, in the case where a steering signal is not inputted from the radio control transmitter in particular, the two-wheeled toy vehicle by radio control 2 is put into a neutral state. In such a state, the servo horn 42 maintains a state of being set up perpendicular to the bike, and thus the rider-like doll 6 is in a state where the center of gravity is centered, with the two-wheeled vehicle body by radio control 4 being in a state where the center of gravity is not tilted.

Second, in the case where a right-hand signal is transmitted from the radio control transmitter, the receiver receives the right-hand signal, and the control portion sends out the right-hand signal to the aforementioned servo system 40. Then, the shafts 44 are driven, and the servo horn 42 starts moving to the right. Then, the pin 46 moves, and thus the body portion 20 tilts to the right through the hole portion 70. Hence, the head portion 22 of the rider-like doll tilts to the right as well. At this time, the head portion 22 is heavier than the body portion 20 in weight, causing the center of gravity of the rider-like doll to tilt to the right. Here, an end portion of the torsion spring 56 on the tilting side is pressed for that the servo horn 42 moves to the right. The other end portion of the torsion spring 56 on the non-tilted side is spaced from the servo horn 42.

Accordingly, movement of the center of gravity of the rider-like doll acts as a trigger that the center of gravity of the radio controlled two-wheeled vehicle body 4 tilts to the right. Moreover, the radio controlled two-wheeled vehicle body 4 is allowed a right-hand turn by predefining that a front wheel portion of the radio controlled two-wheeled vehicle body 4 rotates sensitively to changes in the center of gravity.

More specifically, the rider-like doll portion starts moving its center of gravity so as to move in parallel in synchronization with movement of the servo, and then the bike starts tilting, whereby the center of gravity of the rider-like doll further moves, and thus two-step movement of the center of gravity is achieved.

Additionally, if the radio control transmitter stops transmitting the right-hand turn signal, the end portion of the torsion spring 56 on the tilting side which has been pressed will apply the pressure to the servo horn 42 and push it back. At this time, the torsion spring 56 on one side is only used to push back the tilting on one side, so that sufficient applying force may be obtained, even if wire diameters of the torsion springs 56 are thinned.

On the other hand, if the radio control transmitter transmits a left-hand turn signal, the receiver receives the left-hand turn signal, and the control portion sends out the left-hand turn signal to the aforementioned servo system 40. Then, the shafts 44 are driven, and the servo horn 42 starts moving to the left. Then, the pin 46 moves, and thus the body portion 20 tilts to the left through the hole portion 70. Hence, the head portion 22 of the rider-like doll tilts to the left as well. At this time, the head portion 22 is heavier than the body portion 20 in weight, causing the center of gravity of the rider-like doll to tilt to the left. As is the case with the left-hand turn, it follows from the foregoing that similar operation takes place.

Here, in addition to the center of gravity movement triggered by the signals of the radio control transmitter, movement of the reception after the bike has tilted produces an effect that a turning radius is reduced.

Figure 6:
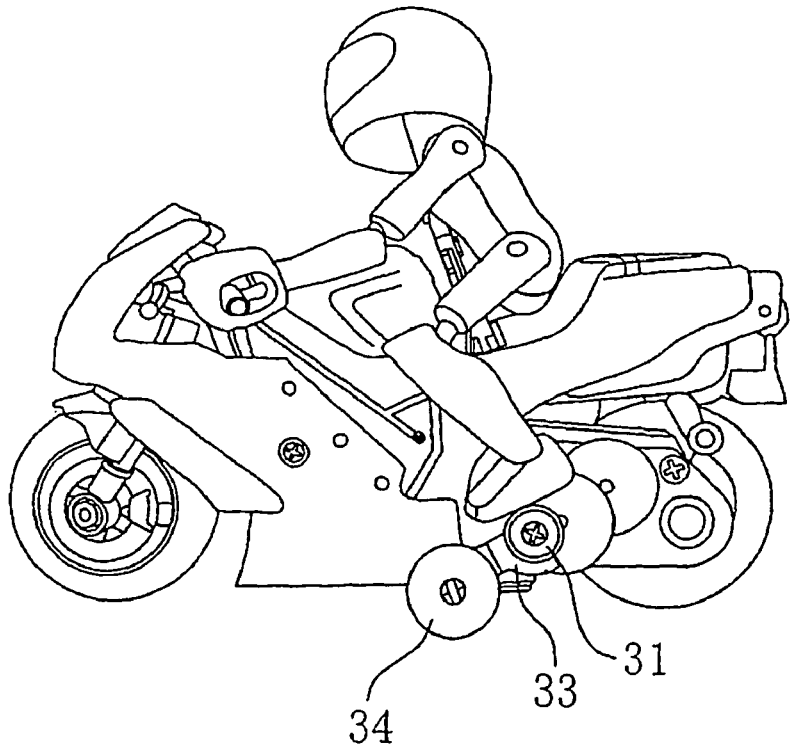
FIG. 6 is a side view illustrating an embodiment of the two-wheeled toy vehicle by radio control according to the present invention.

Next, the pedal portions 30 according to the present invention will be described using FIG. 6. Fist, the pedal portions 30 provide with a first stabilizer 31 at an end portion thereof.

Furthermore, a connecting portion 32 which is pivotally mounted on the both sides of pedal portions 30 is provided outside the first stabilizer 31. Right and left stabilizers are thus mounted to connecting portion 32. This settles the stabilizers at a position of the connecting portion 32, thus providing the same height of the right and left stabilizers on a constant basis. A boss hole portion not shown is provided at a bottom portion of the connecting portion 32. On the other hand, a boss not shown corresponding to said boss hole portion is provided with a protrusion at a bottom portion of the vehicle body. By inserting said boss into said boss hole, the connecting portion 32 is fixed to a predetermined position, and the stabilizers are also fixed.

And, a protrusion portion 33 is provided from a region of the connecting portion 32 mounted with the pedals in a direction perpendicular to the connecting portion 32. A second stabilizer 34 is disposed at an end portion of the protrusion portion 33. Here, the protrusion portion 33 is set so as to rotationally move around the pedal portions 30.

Such configuration as that the second stabilizer 34 is disposed in the lowest section provides the most stable operation.

Then, while stability in steering is lost by raising the protrusion portion 33 as high as that of FIG. 1, a turning radius during steering becomes smaller, thereby giving an operator increased real pleasure of operating the radio controlled two-wheeled vehicle toy.

Moreover, the second stabilizer 34 may be removed from the protrusion portion 33. The removal of the protrusion portion 33 increases operational instability, but increases operational real pleasure of an operator.

In this way, an operator may enjoy an operational feeling by removing the stabilizer, attaching the stabilizer, or changing the height of the stabilizer, depending on his or her various skill levels.

While a preferred embodiment of the present invention has been described hereinbefore, it is to be understood that the present invention is not intended to be limited to the above-described embodiments, and various changes in design may be made without departing from the scope and spirit of the present invention. For example, the present embodiment comprises radio control, but is not operationally restrictive to the radio control. Accordingly, it goes without saying that the present invention may be applied to a toy of the type in which an operating portion is linked to an automatic two-wheeled vehicle toy by a wired connection. Additionally, in the case of a wireless connection, control may be made by using other electromagnetic wave such as infrared radiation, besides radio control such as a radio control car using a conventional ultrahigh flexible band.

Accordingly, a first advantage of the present invention is to be capable of reducing the turning radius by means of the two-step center-of-gravity movement of the rider-like doll.

In addition, use of two torsion springs allows an additional wire diameter per spring, and utilization of proper strain of a spring.

Moreover, it is possible to enjoy maneuver of the radio controlled two-wheeled vehicle toy by switching the degree of difficulty of the maneuver, depending on a user's maneuver skill.

The invention claimed is:

1. A radio-controlled two-wheeled toy vehicle, wherein a front wheel support is mounted on the vehicle body in a way that a steering angle is adjustable, a rider-like doll is swingably attached onto an upper portion of the vehicle body, the rider-like doll is moved perpendicular to a traveling direction and parallel to a horizontal direction with respect to the vehicle body by radio-control, and the front wheel support is tilted for steering by center of gravity movement resulting from the movement of said rider-like doll, whose movement control and running control of the two-wheeled vehicle are under the radio-control, and wherein the movement control of the rider-like doll is mounted in the center of the two-wheeled vehicle, and a drive which serves to drive the rider-like doll is loosely fitted into a hole in a body portion of the rider-like doll.

2. The radio controlled two-wheeled vehicle toy according to claim 1, wherein said body portion of the rider-like doll comprises a head portion which is connected by insertion of a lower protrusion into a concave portion of said body portion, upper arm portions which are connected to said body portion by ball joints, lower arm portions which are connected to said upper arm portions by ball joints, upper extremity portions which are connected to said body portion by ball joints, and lower extremity portions which are connected to said upper extremity portions by ball joints.

3. The radio controlled two-wheeled vehicle toy according to claim 2, wherein in lower arms of the doll, a handle disposed on the uppermost portion of a front wheel of the two-wheeled vehicle running toy in a horizontal direction is loosely fitted into holes in hands provided at ends of said lower arms.

4. The radio controlled two-wheeled vehicle toy according to claim 2, wherein on legs of the doll, pedal portions which are provided with a protrusion in the central lower portion of the two-wheeled vehicle running toy in a horizontal direction are loosely fitted into U shaped portions which are provided with a protrusion on shoe soles on the legs.

5. The radio controlled two-wheeled vehicle toy according to claim 2, wherein a head portion of the doll is heavier than a body portion of the doll in weight.

6. The radio controlled two-wheeled vehicle toy according to claim 2, wherein said hole in a body portion of the doll has a longer diameter of the body in a vertical direction than the diameter of the body in a horizontal direction.

7. The radio controlled two-wheeled vehicle toy according to claim 2, wherein a drive portion comprises a servo portion having a motor built-in, shaft portions located in the center of said motor, a servo horn fitted into end portions of said shaft portions, retainer plate portions which are provided with a protrusion from said servo horn to the central portion in a rotation direction thereof, a pair of torsion spring portions which is connected in series and applied in a way such that said servo horn is sandwiched from both side portions thereof, torsion spring fixed portions in which two shaft portions protrude in torsion spring directions, are respectively inserted into a each torsion spring, and are disposed within the two-wheeled vehicle to fix cyclic portions of each torsion spring.

8. The radio controlled two-wheeled vehicle toy according to claim 1, wherein in lower arms of the doll, a handle disposed on the uppermost portion of a front wheel of the two-wheeled vehicle running toy in a horizontal direction is loosely fitted into holes in hands provided at ends of said lower arms.

9. The radio controlled two-wheeled vehicle toy according to claim 8, wherein on legs of the doll, pedal portions which are provided with a protrusion in the central lower portion of the two-wheeled vehicle running toy in a horizontal direction are loosely fitted into U shaped portions which are provided with a protrusion on shoe soles on the legs.

10. The radio controlled two-wheeled vehicle toy according to claim 8, wherein a head portion of the doll is heavier than a body portion of the doll in weight.

11. The radio controlled two-wheeled vehicle toy according to claim 8, wherein said hole in a body portion of the doll has a longer diameter of the body in a vertical direction than the diameter of the body in a horizontal direction.

12. The radio controlled two-wheeled vehicle toy according to claim 8, wherein a drive portion comprises a servo portion having a motor built-in, shaft portions located in the center of said motor, a servo horn fitted into end portions of said shaft portions, retainer plate portions which are provided with a protrusion from said servo horn to the central portion in a rotation direction thereof, a pair of torsion spring portions which is connected in series and applied in a way such that said servo horn is sandwiched from both side portions thereof, torsion spring fixed portions in which two shaft portions protrude in torsion spring directions, are respectively inserted into a each torsion spring, and are disposed within the two-wheeled vehicle to fix cyclic portions of each torsion spring.

13. The radio controlled two-wheeled vehicle toy according to claim 1, wherein on legs of the doll, pedal portions which are provided with a protrusion in the central lower portion of the two-wheeled vehicle running toy in a horizontal direction are loosely fitted into U shaped portions which are provided with a protrusion on shoe soles on the legs.

14. The radio controlled two-wheeled vehicle toy according to claim 13, wherein a first stabilizer is rotatably mounted at a distal end of a pedal portion.

15. The radio controlled two-wheeled vehicle toy according to claim 14, comprising:

a connecting portion which is rotatably mounted outside a first stabilizer to connect pedal portions on both sides; and a second stabilizer which is provided with a protrusion from a region of the connecting portion mounted with the pedals in a direction perpendicular to the connecting portion, and removably inserted outside an end portion of the protrusion portion.

16. The radio controlled two-wheeled vehicle toy according to claim 1, wherein a head portion of the doll is heavier than a body portion of the doll in weight.

17. The radio controlled two-wheeled vehicle toy according to claim 16, wherein a first stabilizer is rotatably mounted at a distal end of a pedal portion.

18. The radio controlled two-wheeled vehicle toy according to claim 1, wherein said hole in a body portion of the doll has a longer diameter of the body in a vertical direction than the diameter of the body in a horizontal direction.

19. The radio controlled two-wheeled vehicle toy according to claim 18, wherein a first stabilizer is rotatably mounted at a distal end of a pedal portion.

20. The radio controlled two-wheeled vehicle toy according to claim 1, wherein a drive portion comprises a servo portion having a motor built-in, shaft portions located in the center of said motor, a servo horn fitted into end portions of said shaft portions, retainer plate portions which are provided with a protrusion from said servo horn to the central portion in a rotation direction thereof, a pair of torsion spring portions which is connected in series and applied in a way such that said servo horn is sandwiched from both side portions thereof, torsion spring fixed portions in which two shaft portions protrude in torsion spring directions, are respectively inserted into a each torsion spring, and are disposed within the two-wheeled vehicle to fix cyclic portions of each torsion spring.

* * * * *